United States Patent [19]

Entis

[11] Patent Number: 4,474,300

[45] Date of Patent: Oct. 2, 1984

[54] MERCHANDISING DISPLAY DEVICE

[76] Inventor: Allan C. Entis, University St., 89, Tel Aviv, Israel

[21] Appl. No.: 418,581

[22] Filed: Sep. 15, 1982

[30] Foreign Application Priority Data

May 21, 1982 [IL] Israel ..... 65841

[51] Int. Cl.[3] ..... A47F 7/00

[52] U.S. Cl. ..... 211/57.1; 211/4; 211/7; 211/59.1

[58] Field of Search ..... 211/57.1, 4, 7, 8, 59.1; 312/184, 185, 187; 24/201 TR, 255 BS, 260, 374

[56] References Cited

U.S. PATENT DOCUMENTS 920,132 5/1909 Greener ..... 211/57.1
926,337 6/1909 Kershaw ..... 211/8
4,076,126 2/1978 Gilmour ..... 211/4 X
4,217,986 8/1980 Brown ..... 211/57.1

FOREIGN PATENT DOCUMENTS 2404915 8/1974 Fed. Rep. of Germany ..... 24/201 TR
100526 8/1923 Switzerland ..... 24/374

*Primary Examiner*—Ramon S. Britts
*Assistant Examiner*—Blair M. Johnson
*Attorney, Agent, or Firm*—Benjamin J. Barish

[57] ABSTRACT

A merchandising display device includes a display board and a bracket projecting from the front face of the display board for displaying products suspended from the bracket. The bracket includes a locking member for preventing removal of the displayed products unless the locking member is first unlocked.

14 Claims, 13 Drawing Figures

FIG.4a
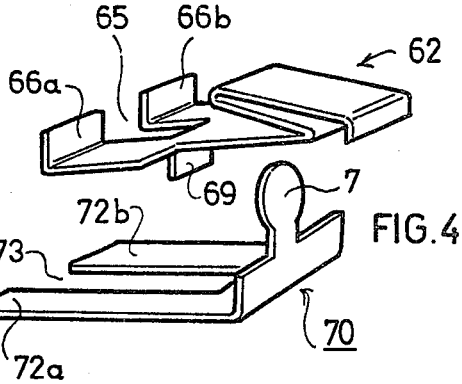
FIG.4b
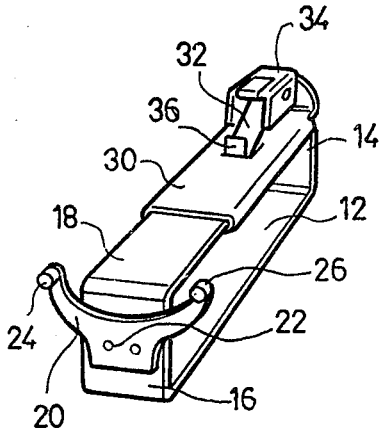
FIG. 3
FIG.5a
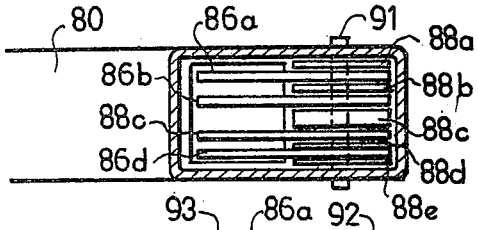
FIG.5b
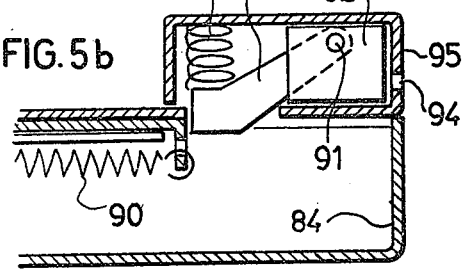
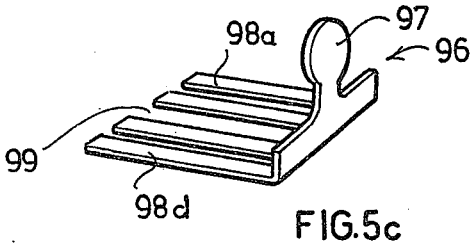
FIG.5c

MERCHANDISING DISPLAY DEVICE

BACKGROUND OF THE INVENTION

The present invention relates to merchandising display devices, and particularly to such devices including a display board and brackets for suspending the products to be merchandised, such as products enclosed within plastic, e.g., blister-type, packages.

Display devices of the foregoing type are commonly used in retail establishments, such as department stores, food markets, and hardware stores, for displaying various types of products within convenient view of the purchaser. However, the easy access to these products to the purchasers has created a serious problem of petty thievery or shoplifting which results in very significant losses to the store owner.

SUMMARY OF THE INVENTION

An object of the present invention is to provide a display device of the foregoing type which permits convenient view and access of the merchandised products to the public but which is designed to substantially reduce the possibility of shoplifting.

According to a broad aspect of the present invention, there is provided a display device adapted to be mounted in cantilever fashion to a display board for supporting a plurality of products therefrom in suspension. The display device comprises a first arm for supporting the products in suspension, means at the rear end of the first arm for mounting it to the display board, a second arm supported in parallel spaced relationship to the first arm, and a locking member disposed on the second arm. The locking member is key-operated, permitting unlocking thereof only upon insertion of the proper key, and is normally in a closed position at the front end of the second arm preventing removal of products from the first arm, but is movable, when unlocked, towards the rear end of the second arm to an open position with respect to the first arm to permit the removal of a product therefrom. Thus, the products suspended from the display device cannot be removed unless and until an attendant, having the proper key, unlocks the locking slide to permit it to be moved to its open position. The locking slide may be constructed so as to include but a simple locking element which can be unlocked in a very convenient manner, or a plurality of locking elements requiring a correspondingly-shaped key for unlocking the slide.

Further features and advantages of the invention will be apparent from the description below.

BRIEF DESCRIPTION OF THE DRAWINGS

The invention is herein described, by way of example only, with reference to the accompanying drawings, wherein:

FIG. 3 is a three-dimensional view illustrating the opposite end of the bracket of FIG. 2;

FIG. 4*a* illustrates another form of locking arrangement that may be used in the device of FIGS. 1–3;

FIG. 4*b* illustrates the key to be used for unlocking the locking member of FIG. 4*a;*

FIG. 5*a* is a top view illustrating another locking member arrangement that may be used with the bracket of FIGS. 1–3;

FIG. 5*b* is a side elevational view of the locking arrangement of FIG. 5*a;*

FIG. 5*c* illustrates the key to be used with the locking arrangement of FIGS. 5*a* and 5*b;*

DESCRIPTION OF PREFERRED EMBODIMENTS

Figure 1:
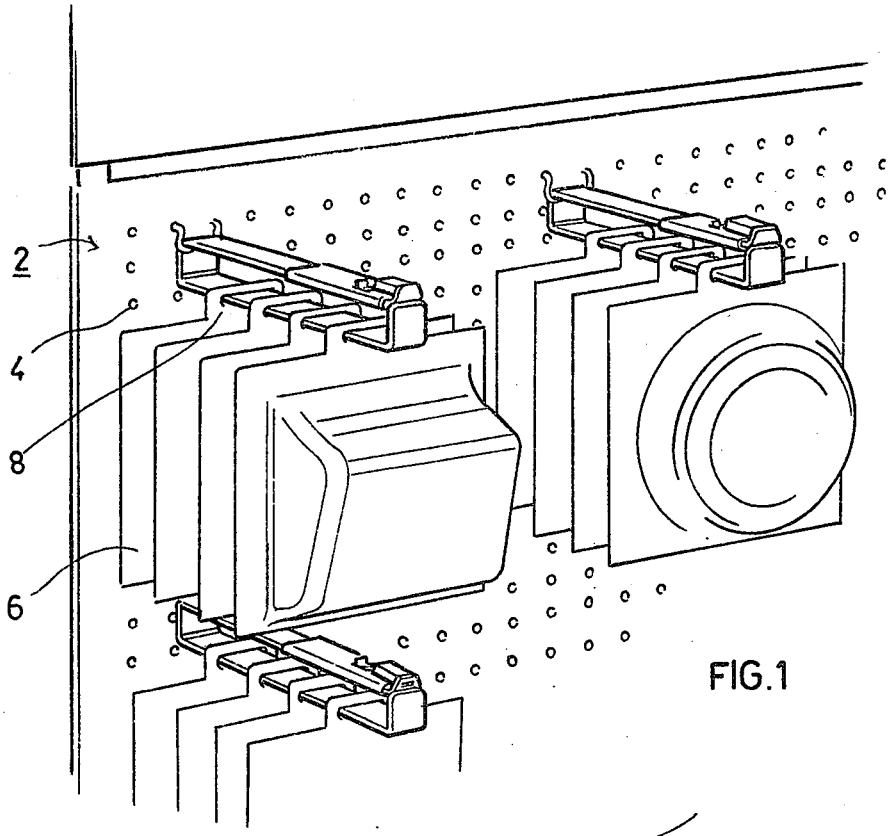
FIG. 1 is a three-dimensional view illustrating one form of display device constructed in accordance with the present invention.
Figure 2:
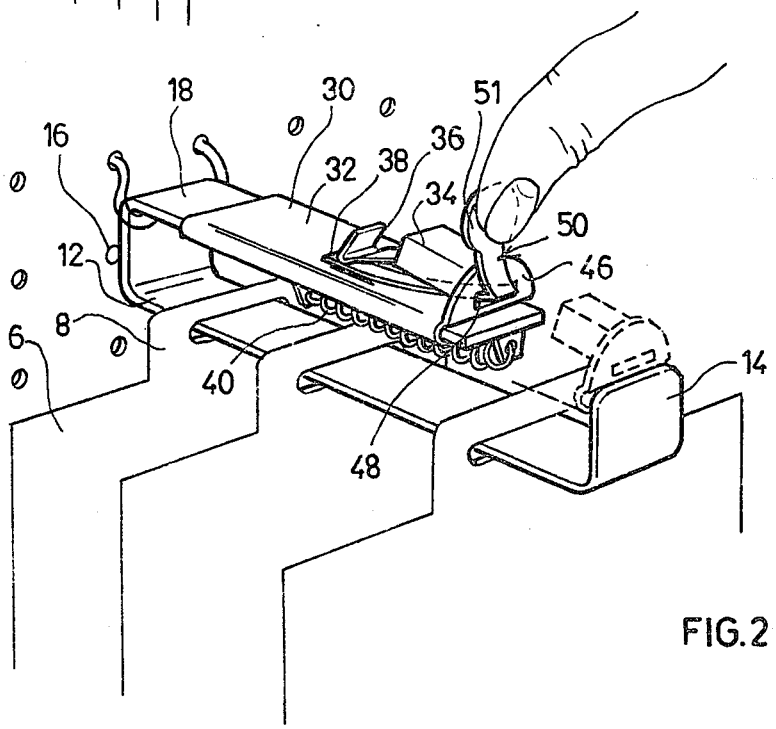
FIG. 2 is an enlarged fragmentary view of the display device of FIG. 1, showing one of the brackets and the manner of unlocking same to permit removal of the articles displayed by the device.

The display device illustrated in FIGS. 1 and 2 comprises a display board, generally designated 2, formed with a plurality of holes 4 for receiving pegs to support, in suspension, a plurality of products 6 to be displayed. Both the display board 2 and the products 6 to be displayed thereby may be of conventional construction, with the products 6 in blister packages, for example, formed at their upper ends with openings 8 for receiving the supporting means, such as brackets or rods, from which they are suspended.

According to the present invention, the means for supporting the products 6 in suspension from the display board 2 are in the form of brackets, generally designated 10, each of which includes a locking member for preventing removal of a displayed product unless the locking member is first unlocked.

More particularly, each of the brackets 10 comprises a lower arm 12 adapted to receive the openings 8 of the packaged products 6 for supporting them in suspension. The lower arm 12 is formed at its front end with an upstanding leg 14, and at its rear end with another upstanding leg 16 joined to an upper arm 18 extending parallel to the lower arm 12 but terminating short of the front leg 14, as shown particularly in FIG. 2. A Y-shaped mounting tab 20 is secured to the rear leg 16, e.g., by rivets 22 (FIG. 3), the outer ends of the mounting tab 20 being formed with pegs or pins 24, 26 receivable within the openings 4 of the display board 2 for mounting the bracket 10 in cantilever fashion to the display board.

The locking member for locking the suspended products 6 to the bracket 10 is in the form of a slide 30 received on the upper arm 18 of the bracket and movable towards and away from its front leg 14. Locking slide 30 carries a leaf spring 32 secured at its front end between a pair of mounting tabs 34 and formed with an upwardly-extending bend 36 at its rear end aligned with a slot 38 formed in the slide 30. Bend 36 of the leaf spring 32 serves as a locking element and is urged downwardly, by the inherent resiliency of the leaf spring 32, through slot 38 and into engagement with the front end of the upper bracket arm 18, when the slide 30 is in its closed position against the front leg 14, as shown in FIG. 3 and in broken lines in FIG. 2. Slide 30 is normally biased to this closed position by means of a coil spring 40 secured at one end to a lug 42 depending from slide 30, and at its opposite end to a lug 44 depending from bracket arm 18.

The mounting tabs 34 securing the front end of leaf spring 32 include a front wall 46 formed with a slot 48 adapted to receive a key 50 (FIG. 2) including a grippable part 51. The key may be inserted by an attendant to engage the underside of leaf spring 32 and thereby to displace same out of slot 38 and out of engagement with the end of bracket arm 18 for unlocking the slide 30 to permit the slide to be moved to its open position as illustrated in full lines in FIG. 2.

The manner of using the display device illustrated in FIGS. 1–3 of the drawings will be apparent from the above description. Each of the brackets 10 may be loaded with a plurality of the packaged products 6 to be displayed by unlocking the slide and moving it to its open position. This is done by inserting key 50 through slot 48 in the locking slide 30 which key moves under the leaf spring 32 to cause its locking end 36 to disengage from the end of the bracket arm 18, thereby unlocking the slide, and then moving the slide 30 rearwardly towards the mounting pins 24, 26. With the slide 30 in its thus opened position (shown in full lines in FIG. 2) a plurality of the packaged products may be loaded onto the lower arm 12 of bracket 10 by passing the openings 8 of the packages through the front leg 14 of the bracket and then sliding the packages along the lower arm 12. After the bracket 10 has been thus loaded with a plurality of the packaged articles 6, the slide 30 is released, permitting it to close by the action of spring 40.

Now, whenever a customer wishes to purchase one of the displayed articles, he would so inform the attendant, who would then pass the unlocking key 50 through the slot or key opening 48 of the locking slide 30, and under the leaf spring 32 to unlock the slide 30 and to move same to its open position, as described above when originally loading the bracket with the products 6 to be displayed. This opening of the slide 30 permits one or more of the packaged products to be removed, whereupon the key 50 would be withdrawn, permitting spring 40 to return the slide 30 to its closed position against the front leg 14. The return of the slide also causes it to lock in this closed position by the locking element 36 of the leaf spring 32 engaging the front end of the bracket arm 18.

It will thus be seen that a displayed product 6 cannot be removed from its bracket 10 without using a proper key (50) to unlock the locking slide 30 and to move same to its open position. It will also be seen that the unlocking of the slide and the movement of the slide to the open position can both be performed by one simple manual operation, of inserting the key 50 through slot 48 and pushing same towards the display panel 2.

FIG. 4*a* illustrates a modification in the construction of the leaf spring locking arrangement to preclude unlocking the slide by merely inserting a hairpin or the like. Thus, the leaf spring in FIG. 4*a*, therein designated 62, is formed at its rear end with a slot 65 to define two spaced upwardly-bent ends 66*a*, 66*b*, serving as the locking elements engageable with the front end of the upper bracket arm (18 in FIG. 2). The slot 65 defining the two locking elements 66*a*, 66*b* is formed by a cut-out which is bent downwardly to define a depending tab 69 between the two locking elements.

The leaf-spring locking arrangement illustrated in FIG. 4*a* is to be used with a key, such as illustrated at 70 in FIG. 4*b*, including a grippable front end 71 and a pair of tongues or unlocking elements 72*a*, 72*b* separated by a slot 73. The width of slot 73 is equal to the width of the depending tab 69 of the leaf spring 62 in FIG. 4*a*, so that when key 70 is inserted through the keyhole in the front wall of the locking slide (slot 48 in front wall 46 of locking slide 30 in FIG. 2), the two unlocking tongues 63*a*, 63*b* of the key 70 will engage the two locking elements 66*a*, 66*b* of the leaf spring 62 (FIG. 4*a*) to cause these locking elements to disengage from the front end of the upper bracket arm (18, FIG. 2) on which the slide is mounted, as described above with respect to the embodiment of FIGS. 1–3. The modification of FIGS. 4*a* and 4*b*, therefore, will also permit the slide to be unlocked and moved to its open position by a simple manipulatable movement as described above with respect to FIGS. 1–3, except that it precludes the use of a hairpin or other similar article from unlocking the slide since a locking key, such as illustrated in FIG. 4*b*, would be required in order to engage both of the locking elements without engaging the depending tab 69.

FIGS. 5*a*–5*c* illustrate a still further locking arrangement which may be used, particularly when it may be desirable to have different unlocking keys at different locations.

Thus, in the arrangement of FIGS. 5*a*–5*c*, the locking slide 80 is slidably mounted on the upper bracket arm 88 and is urged to its closed position against the front bracket leg 84 by spring 90, in the same manner as described above with respect to the corresponding elements in FIGS. 1–3. Here, however, the locking is effected by a plurality of individual locking elements 86*a*, 86*b* pivotably mounted at their front ends to a common pin 91 extending transversely across the spring-mounting tabs 92. Each of the locking elements 86*a*–86*d* is separated from the others, and from the side walls of the spring mounting 92, by spacer discs 88*a*–88*e* also assembled by the common mounting pin 91. These discs, however, are of rectangular configuration, and therefore limit against upper wall of spring mounting 92, preventing them from pivoting on pin 91.

The locking elements 86*a*–86*d* all project below the lower edge of the spacer discs 88*a*–88*e* and are urged to this position by individual springs 93. The keyhole slot 94 formed in the front wall 95 of the spring-mounting 92 is located above the bottom edge of the spacer discs 88*a*–88*d* so that the latter discs block the insertion of any key which is not provided with slots to accommodate the spacer elements.

The key to be used with the locking arrangement illustrated in FIGS. 5*a* and 5*b* is shown in FIG. 5*c*, wherein it is generally designated 96. Thus, this key includes a manipulatable element 97 graspable by the user, and a plurality of tongues 98*a*–98*d* corresponding to the number of locking elements 88*a*–88*d*, with the tongues being spaced from each other by slots 99 corresponding to the number and dimensions of the spacer elements 88*a*–88*d*.

It will thus be seen that only a proper key, such as illustrated in FIG. 5*c*, can be used with the locking arrangement illustrated in FIGS. 5*a* and 5*b*. In all other respects, the device illustrated in FIGS. 5*a* and 5*b* is constructed in, and operates in, the same manner as that described above with respect to FIGS. 1–3.

Figure 6:
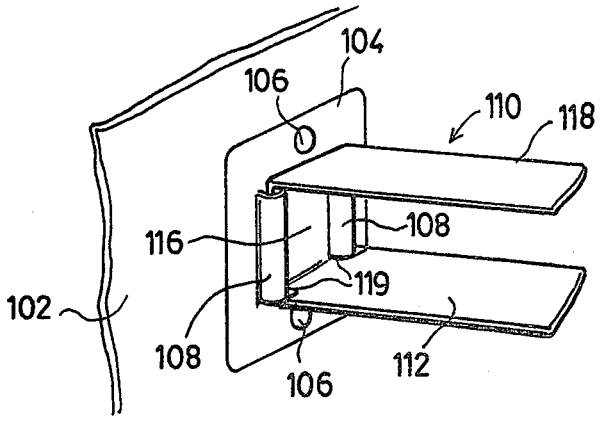
FIG. 6 is a fragmentary view illustrating another method of mounting the bracket to the display board.

FIG. 6 illustrates a variation wherein the display bracket, therein generally designated 110, is more securely mounted to the display board, therein designated 102. For this purpose, the display board 102 is provided with a plurality of mounting plates 104, one for each of the brackets 110, each mounting plate being secured to the display board 102 by a pair of fasteners 106. Each mounting plate 104 further includes a pair of guiding lugs 108 for receiving its respective display bracket 110.

The display bracket 110 includes a lower arm 112 for receiving the products to be displayed, an upper arm 118 for receiving the locking slide (not shown), and a vertical leg 116 at the rear end of arms 112 and 118, and connecting them together, which leg is received within the guiding lugs 108 of the mounting plate 104. The lower bracket arm 112 is formed with a pair of cut-outs 119 at the juncture with the vertical leg 114 so as to permit the bracket to be inserted from above into the guiding lugs 108 of the mounting plate 104.

In the arrangement illustrated in FIGS. 1–6, the display bracket is made of a strip or bar of material, such as metal, of rectangular cross-section, with the locking member being in the form of a slide received on the bracket. It will be appreciated that other forms of brackets and locking members may be used.

Figure 7:
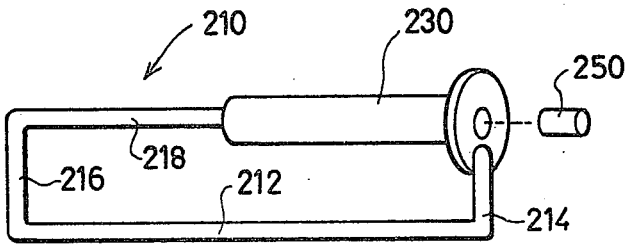
FIG. 7 illustrates another form of display bracket constructed in accordance with the present invention.

One such other form is illustrated in FIG. 7, wherein the display bracket, therein designated 210, is constituted of a cylindrical rod bent to form the lower arm 212 for receiving the products to be displayed, the front leg 214, the rear leg 216, and the upper arm 218 receiving the locking member. In this case, the locking member is in the form of a tube 230 telescopingly receivable in the end of the upper arm 218. Locking tube 230 is normally biased against the front leg 214 so as to prevent the removal of the products displayed from bracket arm 212, but upon the insertion of a proper key 250, the locking tube 230 may be moved away from leg 214 (leftwardly in FIG. 7) to open the bracket arm for removal of products suspended from arm 212.

More particularly, locking tube 230 includes a first collar 232 secured to the front end of tube 230 and containing the keyhole for receiving the key 250; a second collar 234 secured to and within tube 230 at an intermediate position thereof and formed with a bore through which the upper bracket arm 218 freely passes; and a third collar 236 secured at the inner end of the tube 230 to the upper bracket arm 218. Tube 230 further includes an annular flange 238 at its inner end, and a coil spring 240 interposed between collar 234 and 236 so as to urge the tube 230 forwardly against the front leg 214, and thereby its end flange 238 against collar 236 fixed to the upper bracket arm 218. This is the closed condition of the locking tube 230.

Figure 9:
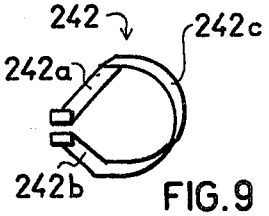
FIG. 9 illustrates the details of the locking spring used in the display bracket of FIGS. 7, 8*a* and 8*b*.
Figure 8A:
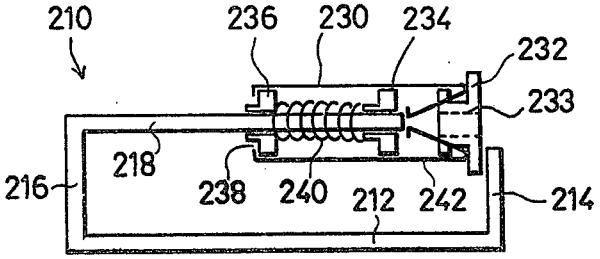
FIGS. 8*a* and 8*b* illustrate the display bracket of FIG. 7 in its closed and opened positions, respectively.
Figure 8B:
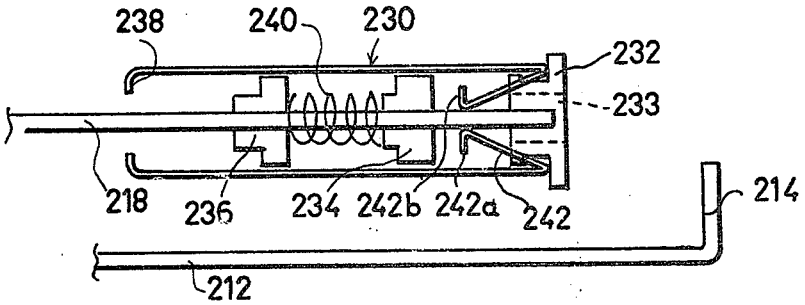

The locking tube 230 further includes a leaf-spring 242 which normally engages the end of the upper bracket arm 218 to prevent the locking tube 230 from being moved to its open position. Leaf spring 242 may have the construction as illustrated in FIG. 9, including a pair of legs **242*a*, 242*b* whose end tips are bent outwardly so as to provide an enlarged surface engageable with the end face of the upper bracket arm 218, the two legs being connected by a connecting rib 242*c* received within an annular slot formed in the front collar 232**.

The locking position of tube 230 is shown in FIG. **8*a*, with the front face of its collar 232 engaging the front leg 214 of the display bracket 210, and with the bent tips of the two legs 242*a*, 242*b* of the leaf spring 242 engaging the front face of the upper bracket arm 218**, thereby preventing the locking tube from being moved rearwardly along that bracket arm.

Whenever it is desired to unlock the display bracket in order to permit the removal of a product suspended from its lowermost bracket arm 212, a key 250 is inserted through the keyhole 233 formed in the front collar 232, which keyhole may be of annular shape to accommodate the tubular shape of the key 250. When the key is thus inserted, it engages the locking legs **242*a*, 242*b* of the leaf spring 242, spreading them apart and out of engagement with the front face of the upper bracket arm 218, thereby permitting the locking tube 230 to be manually pushed rearwardly away from the front leg 214, to open the bracket and to permit the removal of products suspended from the lower arm 212** of the bracket.

If desired, tube 230 may be keyed against rotation by providing a keying rib and slot arrangement between it and collar 36 fixed to bracket arm 218. Also, the key 250 and its keyhole 233 may be of a coded construction to assure that only the proper key will unlock the bracket.

While the invention has been described with respect to several preferred embodiments, it will be appreciated that these are shown purely for purposes of example, and that many other variations, modifications and applications of the invention may be made.

What is claimed is:

1. A display device adapted to be mounted in cantilever fashion to a display board for supporting a plurality of products therefrom in suspension, said display device comprising a first arm for supporting the products in suspension, means at the rear end of said first arm for mounting same to the display board, a second arm supported in parallel spaced relationship to said first arm, and a locking member disposed on said second arm, said locking member being key-operated and permitting unlocking thereof only upon the insertion of the proper key, said locking member normally being in a closed position at the front end of said second arm preventing removal of products from said first arm, but being movable, when unlocked, towards the rear end of said second arm to an open position.

2. The display device according to claim 1, wherein said first arm includes an upstanding leg at its front end and said second arm overlies said first arm, said locking member being spring biased towards said upstanding leg.

3. The display device according to claim 1, wherein said locking member comprises a slide and locking element spring-urged against a stop for locking said slide in its closed position, said locking element being displaceable, by the insertion of a proper key, away from said stop to unlock the slide.

4. The display device according to claim 3, wherein said locking element is carried by said slide, and said stop is defined by the end of said second arm of the bracket.

5. The display device according to claim 4, wherein said locking element is formed in a leaf spring urged to its locking position by its inherent resiliency.

6. The display device according to claim 3, wherein said locking slide comprises a plurality of said locking elements spaced from each other by spacer elements and spring-urged against said stop, said key comprising a corresponding plurality of spaced unlocking elements to engage the locking elements and to displace them all from said stops upon the insertion of the key.

7. The display device according to claim 6, wherein said plurality of locking elements are included in a strip of resilient material integrally formed with cut-outs and bends to define said locking elements and said spacer means, all said locking elements being spring-urged to their locking positions by the resiliency of said strip.

8. The display device according to claim 6, wherein said plurality of locking elements are individual elements pivotably mounted to a common pin and spaced by intermediate spacing elements fixed to said pin, said individual locking elements being spring-urged to their locking positions.

9. The display device according to claim 1, wherein said second arm is a cylindrical rod, and said locking member is a tube telescopically mounted on the end of said second arm.

10. The display device according to claim 9, wherein said tube comprises a locking element spring-biased into engagement with said end of the second arm, but movable out of engagement therewith by the insertion of the proper key.

11. The display device according to claim 10, further including a first collar secured to the front end of said tube and containing the keyhole, a second collar secured to and within said tube at an intermediate position thereof and formed with a bore through which said second arm freely passes, a third collar secured to said second arm at the inner end of said tube, a stop at the inner end of said tube, and a compression spring interposed between said second and third collars for urging said tube against said upstanding leg at its front end, but being movable, by the insertion of the proper key through said first collar, to cause the spring-biased locking element to disengage from the end of the second arm, and thereby to permit the tube to be moved along said second arm away from said upstanding leg of the first arm.

12. The display device according to claim 11, wherein said locking element is a leaf spring formed with a web portion received over said first collar and a pair of legs normally engaging said end of the second arm.

13. The display device according to claim 1, wherein said mounting means at said rear end of the first arm comprises a plurality of pins receivable within holes in the display board.

14. The display device according to claim 1, wherein said mounting means at the rear end of said first arm comprises a vertical leg receivable within a pair of spaced guides carried by a mounting plate fixed to the display board.

* * * * *